US006568085B1

(12) United States Patent
Bede

(10) Patent No.: US 6,568,085 B1
(45) Date of Patent: May 27, 2003

(54) GRIP REMOVAL APPARATUS

(76) Inventor: James M. Bede, 3470 Coventry Lakes Dr., Medina, OH (US) 44256

( * ) Notice: Subject to any disclaimer, the term of this patent is extended or adjusted under 35 U.S.C. 154(b) by 143 days.

(21) Appl. No.: 09/681,219

(22) Filed: Feb. 27, 2001

Related U.S. Application Data

(60) Provisional application No. 60/185,982, filed on Mar. 1, 2000.

(51) Int. Cl.[7] ..... B21F 13/00
(52) U.S. Cl. ..... 30/90.4
(58) Field of Search ..... 30/90.4, 90.6, 30/293, 294; 473/298, 300; 16/421

(56) References Cited

U.S. PATENT DOCUMENTS 4,839,986 A * 6/1989 Grantham ..... 30/90.4 X

* cited by examiner

*Primary Examiner*—Douglas D. Watts
(74) *Attorney, Agent, or Firm*—Christopher L. Parmelee; Walker & Jocke

(57) ABSTRACT

An apparatus for removing golf club grips. The apparatus (10) includes a body (12) with an integral handle (14). The body further includes a shaft guide (16) with concave portions (18) and (20) for guiding the apparatus along the shaft of the golf club. The apparatus includes a pair of brackets (26) and (28) that are operative to releasably and adjustably hold inwardly curved blades (30) and (32). The apparatus is used to remove golf grips by placing the end of the golf club on the ground. The shaft of the club may then be placed adjacent the concave portions of the shaft guide. By pushing the apparatus along the club shaft the blades are operative to create two parallel slices in the grip along the club shaft. The cut out portion of the grip between the parallel slices is directed away from the shaft by a ramp (56).

13 Claims, 5 Drawing Sheets

GRIP REMOVAL APPARATUS

CROSS REFERENCE TO RELATED APPLICATIONS

This application claims benefit of U.S. Provisional Application Serial No. 60/185,982 filed Mar. 1, 2000.

TECHNICAL FIELD

This invention relates to a grip removal apparatus. Specifically this invention relates to a new apparatus for removing grips from golf clubs.

BACKGROUND ART

Golf clubs generally include grips on the ends of their shafts to improve a golfer's hold on the club. Grips enable a golfer to better control the swing of a club and also prevent the club from sliding away from the golfer's hands during a swing. Over time golf club grips may become worn. However rather than replacing the entire club, it is much less expensive to replace the worn grip with a new grip. Methods for removing grips from golf clubs are known. For example, golf club grips may be removed by hand using a knife or razor blade to slice through the grip in a line along the length of the grip. The grip may then be peeled away from the shaft and discarded. Unfortunately this process requires a considerable amount of time. Also this method of removing the grip may damage the club shaft. Graphite shafts in particular are relatively soft and highly susceptible to damage from scrapes or gouges caused by a knife or razor blade.

Although grip cutting devices have been developed which claim to improve the grip removing process, such devices have similar disadvantages as conventual knife blades. For example such devices typically include a cutting portion which is designed to be locked into a workbench vice. As with knives, the cutting portion may damage the club shaft.

Consequently there exists a need for an apparatus that is faster and more efficient at removing grips from golf clubs. There is a further need for an apparatus that can remove golf grips without damaging the shaft of the golf club. There is also a need for an apparatus for removing golf grips that is not required to be mounted in a vice.

DISCLOSURE OF INVENTION

It is an object of the exemplary form of the present invention to provide an apparatus for removing grips.

It is a further object of the exemplary form of the present invention to provide an apparatus for removing grips that is faster at slicing through a grip than a conventual knife blade.

It is a further object of the exemplary form of the present invention to provide an apparatus for removing grips that does not damage the shaft of the golf club.

It is a further object of the exemplary form of the present invention to provide an apparatus for removing grips that can accommodate different sizes of club shafts.

It is a further object of the exemplary form of the present invention to provide an apparatus for removing grips that is adjustable to accommodate different sizes of club shafts.

It is a further object of the exemplary form of the present invention to provide an apparatus for removing grips that includes replaceable blades.

It is a further object of the exemplary form of the present invention to provide an apparatus for removing grips that does not require the use of a vice.

It is a further object of the exemplary form of the present invention to provide an apparatus for removing grips that is portable.

Further objects of the present invention will be made apparent in the following Best Modes for Carrying Out Invention and the appended claims.

The foregoing objects are accomplished in one exemplary embodiment of the invention by a hand-held apparatus that cuts a grip of a golf club as the apparatus is slid along the shaft of the golf club. The apparatus comprises a body that includes a shaft guide and a handle. The shaft guide includes one or more concave portions for receiving the shaft of a golf club. By grasping the handle a user is enabled to slide the shaft guide along the shaft of the club.

In the exemplary embodiment the apparatus further includes two brackets in operative connection with the apparatus body adjacent the forward end of the shaft guide. Each bracket is operative to hold a removable blade such that the face of the blade is oriented about perpendicular or close to perpendicular with respect to a surface of the shaft with the edge of the blade facing forward. The exemplary angular separation between the blades is about 60 degrees.

In the exemplary embodiment the cutting edge of the blades are inwardly curved. When the apparatus is slid across the shaft of the club, the blades create two parallel slices through the grip along the shaft. The curve-shaped blades are operative to cause the cut out portion of the grip between the parallel slices to be directed outwardly from the shaft. Also the body of the apparatus includes a ramp surface beneath the forward concave portion of the shaft guide. The ramp surface further assists in lifting and peeling away the cut portion of the grip from the club shaft. This feature of the exemplary embodiment enables the apparatus to slice through the grip more smoothly by preventing the cut portion of the grip from curling up against the body of the apparatus.

The shafts of golf clubs come in many diameters, consequently the positions of the blades relative the shaft guide may not be adequate for all sizes of club shafts. Thus the exemplary embodiment includes features which are selectively adjustable for moving the end of the cutting blade relative the surface of the club shaft. In one exemplary embodiment, each bracket is operative to pivot relative the body of the apparatus. This is accomplished in the exemplary embodiment by connecting the brackets to the apparatus body with a pair of machine screws. The forward most aperture in each bracket for receiving a machine screw is elongated. This enables the forward end of each bracket to pivot up or down for changing the height of the cutting blades relative to the club shaft. In an alternative embodiment the forward concave portion of the shaft guide is configured to move up or down relative the cutting blades.

BEST MODES FOR CARRYING OUT INVENTION

Figure 1:
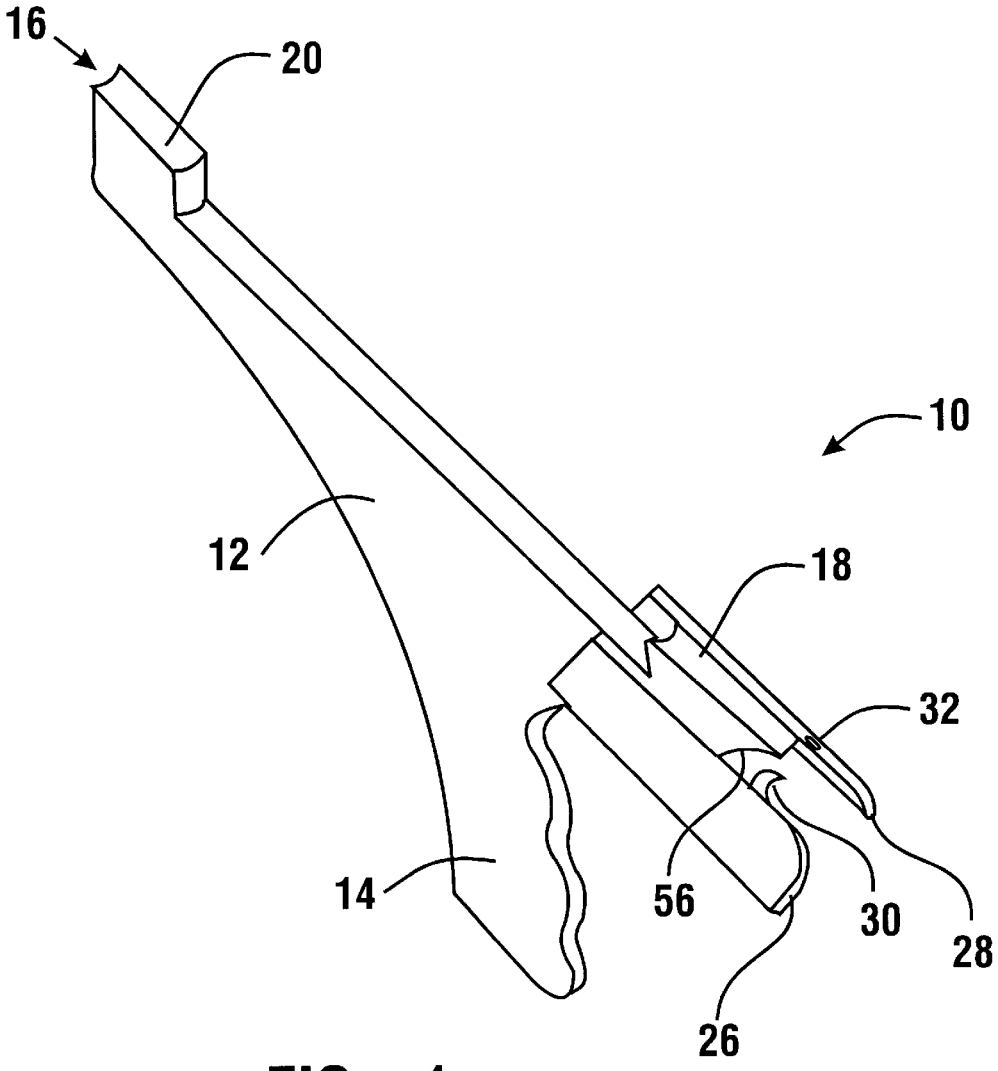
FIG. 1 is a perspective view representative of an exemplary embodiment of the grip removing apparatus.
Figure 4:
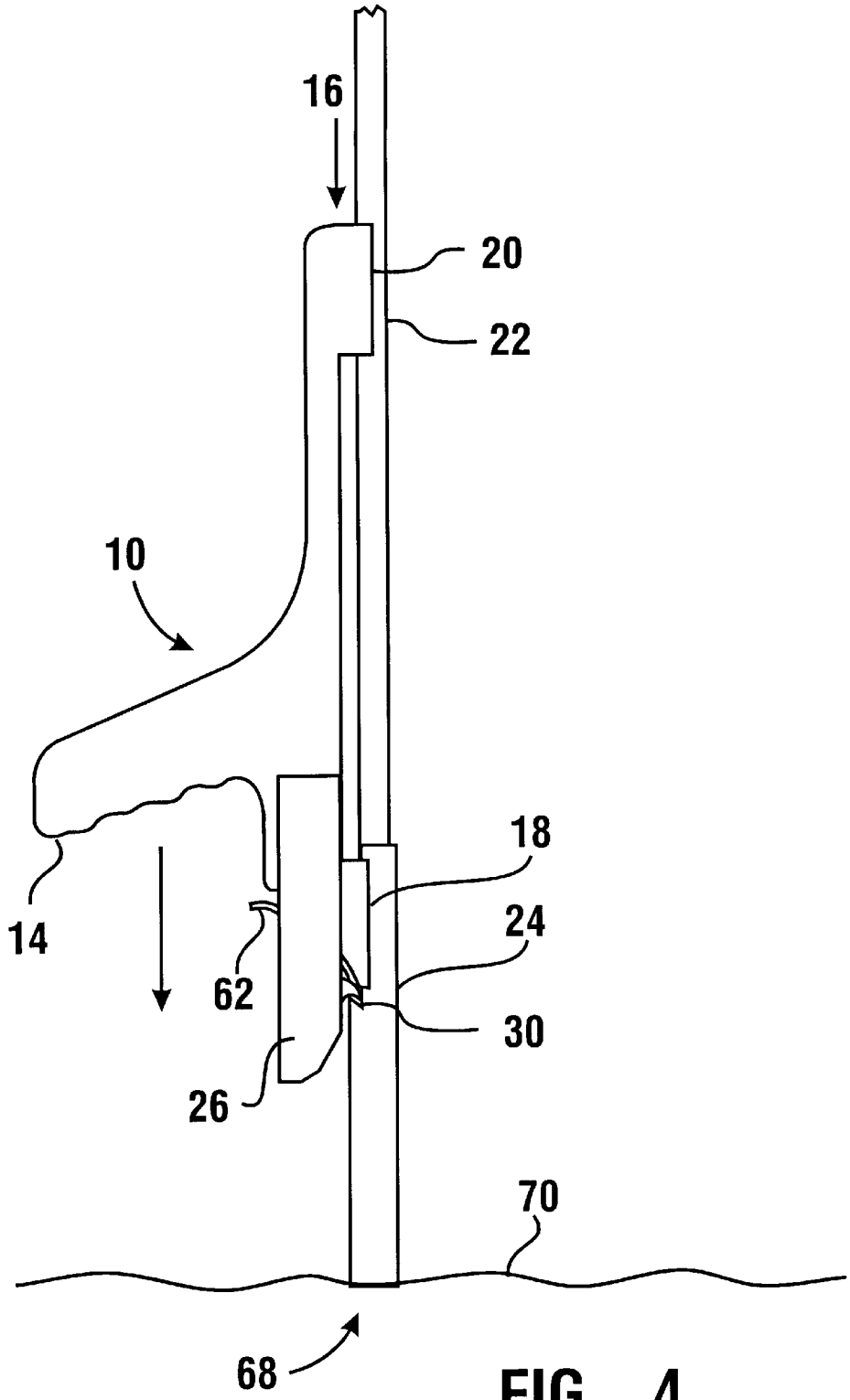
FIG. 4 shows an exemplary embodiment of the present invention that is in the process of removing a grip from a golf club.

Referring now to the drawings and particularly to FIG. 1, there is shown therein a perspective view representative of an exemplary embodiment of the grip removing apparatus. Here the grip removing apparatus 10 includes a body 12. The body 12 includes an integral handle 14 and a shaft guide 16. The shaft guide 16 includes a forward concave portion 18 and an aft concave portion 20 that are operative to receive the shaft of a golf club. FIG. 4 shows an exemplary view of the apparatus 10 positioned adjacent a club shaft 22 of a golf club.

The shaft guide 16 is operative to align the club shaft 22 in a position for removing the grip 24 of the golf club from the shaft 22. In the exemplary embodiment the distance between the two concave portions is between ten and twelve inches. Alternative embodiments of the present invention may have longer or shorter shaft guides depending on the amount of control and the overall size of the apparatus that is desired. Also alternative embodiments of the shaft guide may include just one continuous concave portion.

Figure 3:
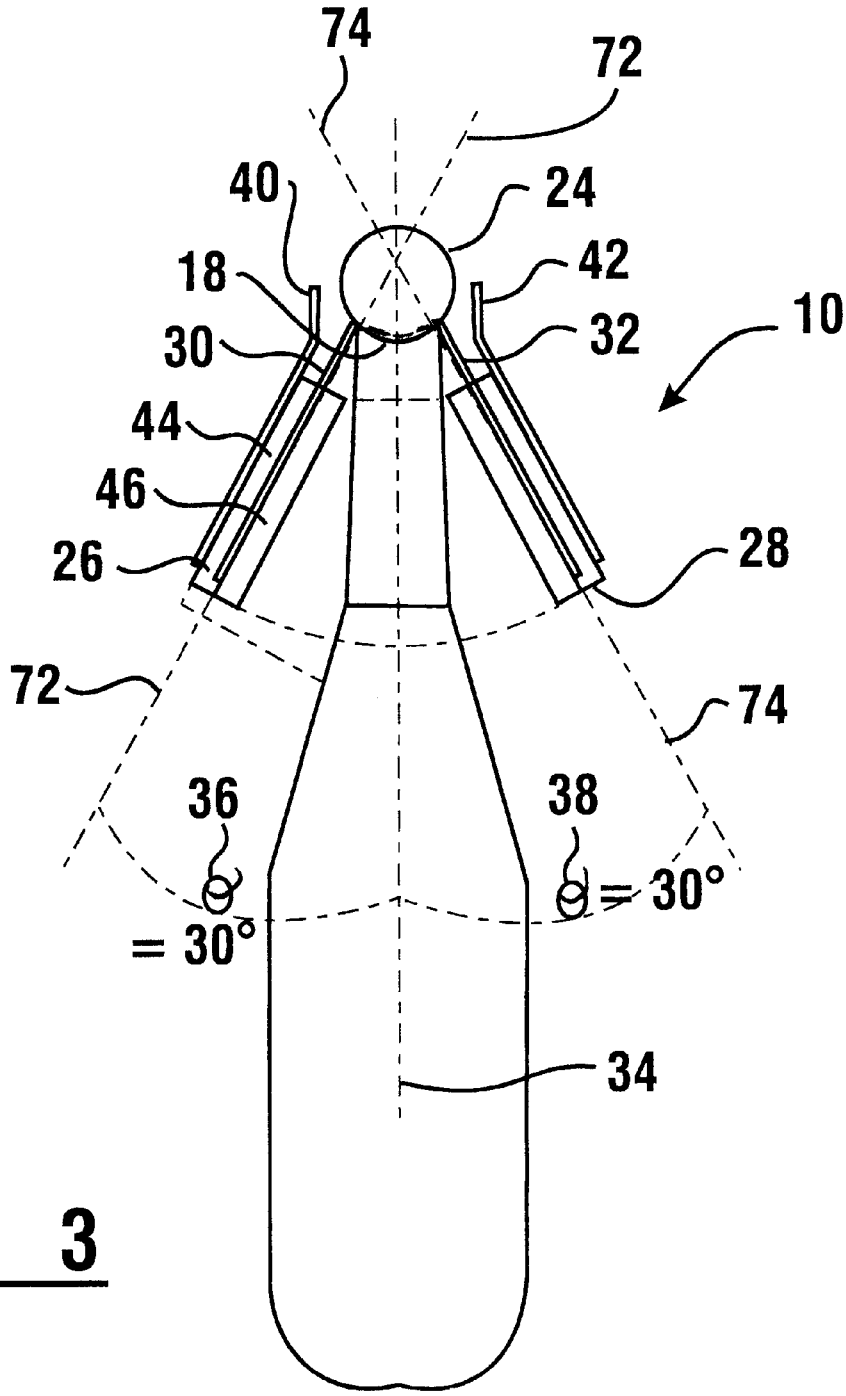
FIG. 3 is a front plan view representative of the exemplary embodiment of the grip removing apparatus.

As shown in FIG. 3, the exemplary embodiment of the present invention includes two brackets 26 and 28. The brackets are operative to hold two blades 30 and 32 in positions for slicing two longitudinal cuts through a grip of a golf club as the apparatus 10 is slide along the shaft of a golf club. In the exemplary embodiment the blades 30 and 32 extend in generally radial directions 72 and 74 with respect to a club shaft placed adjacent the shaft guide 16. In addition as shown in FIG. 1, each blade 30 is positioned a small distance in front of the concave portion 18 of the shaft guide 16 with their cutting edge 66 facing forward.

As shown in FIG. 3, the brackets 26 and 28 for the exemplary embodiment are connected to the sides of the body 12 such that each blade 30 and 32 is positioned at about a 30 degree angle 36 and 38 with respect to the lower portion of a vertical plane 34 that bisects the concave portion 18 of the shaft guide. In alternative embodiments of the present invention the blades may be orientated at other angles which are generally closer to being normal with respect to the surfaces of the shaft or grip than being tangent to the surfaces of the shaft or grip. When the apparatus 10 is slid along the club shaft 24, this exemplary orientation of the blades 30 and 32 is operative to create two parallel slices through the grip that are about ¾ of an inch apart.

By slicing through the grip with cutting blades which extend generally radially with respect to the surface of the golf club shaft and grip, the exemplary embodiment minimizes the thickness of the portion of the grip that must be cut therethrough. This exemplary configuration further minimizes the amount of force that is required to slice through the grip. In addition aligning the blades in this described manner has been found to work well with many different sizes and styles of club shafts and grips. However, it is to be understood that alternative embodiments of the present invention may have blades spaced apart by different amounts and at different angles depending on the performance characteristics desired for the apparatus and the size and shape of the grips being removed.

The exemplary embodiment of the apparatus 10 includes safety guards 40 and 42 as shown in FIG. 3. The safety guards 40 and 42 extend upwardly from the brackets 26 and 28 and are operative to minimize injuries to an operator that may be caused by the blades 30 and 32.

The brackets 26 and 28 are operative to hold replaceable blades 30 and 32. As shown with reference to bracket 26, the blade 30 is sandwiched between two sections 44 and 46 of the bracket 26. In the exemplary embodiment the top section 44 is releasably connected to the lower section 46 with a plurality of machine screws (not shown). This enables the top section 44 to be removed for replacing the blade 30.

Figure 2:
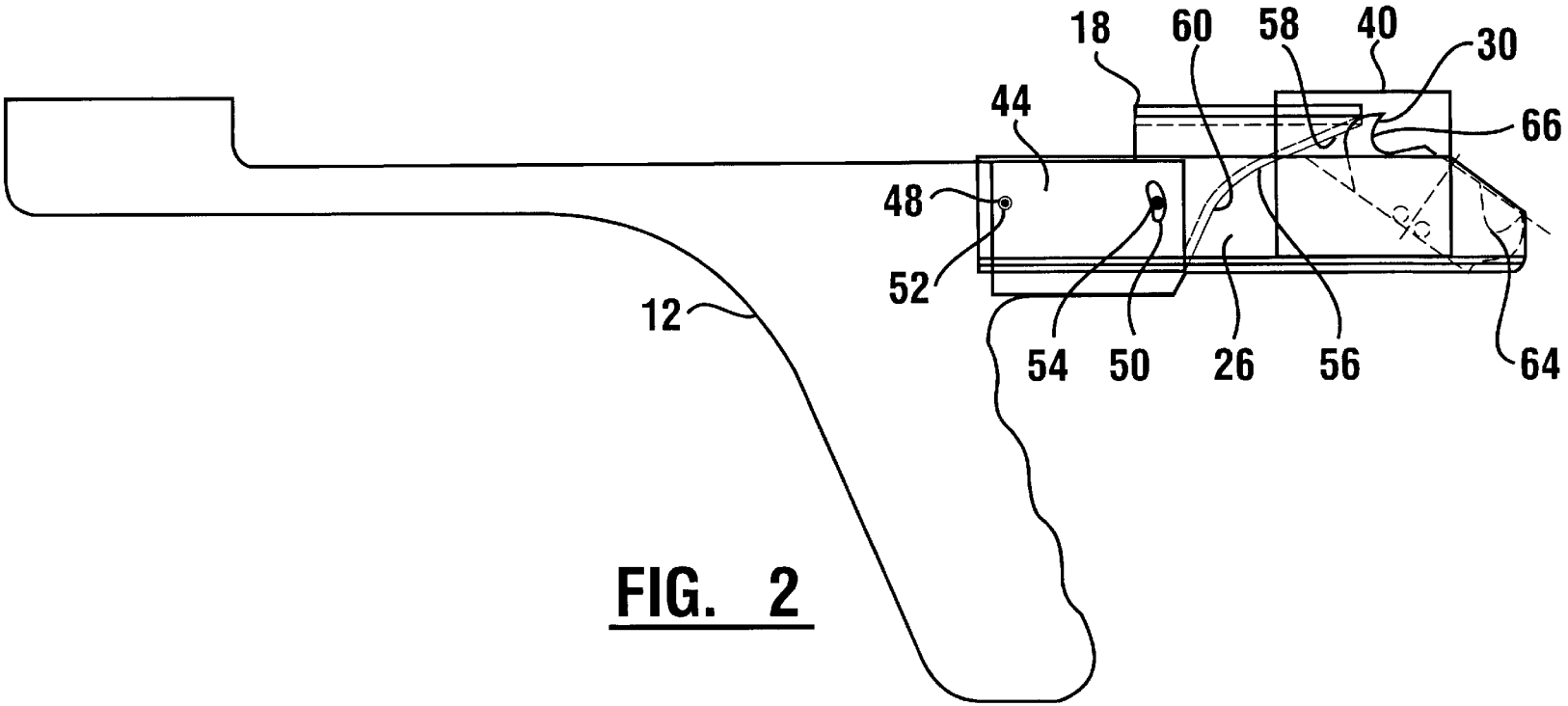
FIG. 2 is a side view representative of the exemplary embodiment of the grip removing apparatus.

FIG. 2 shows a side view representative of the exemplary embodiment of the present invention. Here the internal structure of the bracket 26 is shown in more detail. The bracket 26 includes two apertures 48 and 50 that are operative to receive machine screws 52 and 54. In the exemplary embodiment the forward aperture 50 is elongated. This enables the front of the bracket to be aligned in different positions for adjusting the height of the blade 30 with respect to a club shaft. For larger diameter club shafts, it may be necessary to move the blade 30 to a lower position. This can be accomplished by loosening the machine screw 54 and pivoting the bracket 26 with respect to the rearward machine screw 52 in a downward direction. The forward machine screw 54 may then be retightened to secure the blade 30 in the lower position relative the club shaft. The blades may be raised by reversing this procedure.

Figure 5:
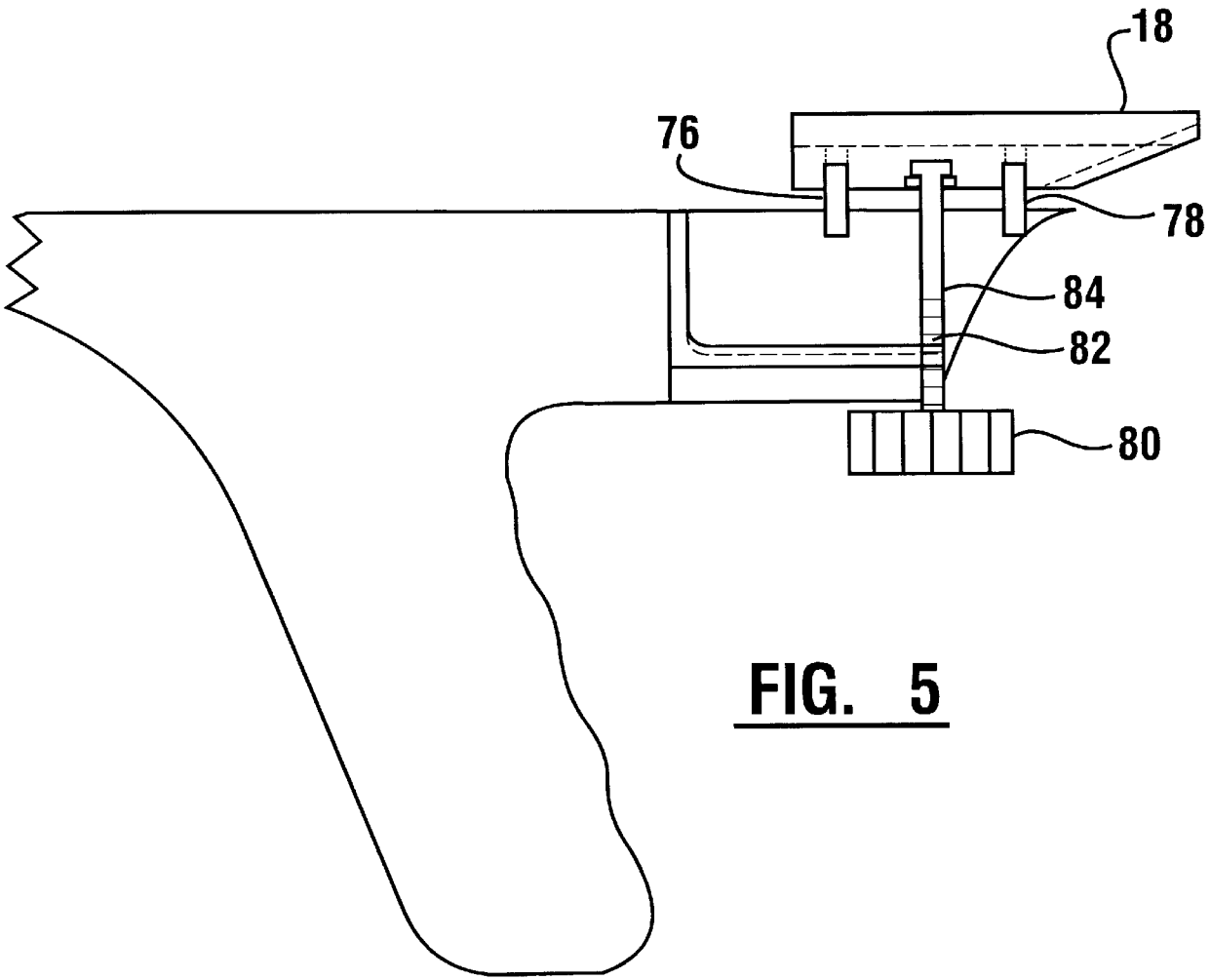
FIG. 5 shows an alternative exemplary embodiment of the present invention that includes a forward concave portion of the shaft guide that is adjustable in height with respect to the cutting blades.

In an alternative embodiment of the present invention, rather than adjusting the height of the blade by changing the position of the brackets 26 and 28, the forward concave portion 18 of the shaft guide may be configured to adjustably move up or down with respect to the apparatus body 12. An example of such an alterative exemplary embodiment is shown in FIG. 5. Here the body 12 of the apparatus includes support guides 76 and 78 and the forward concave portion 18 is in sliding connection with supporting guides 76 and 78. The apparatus further includes an adjustment wheel 80. The adjustment wheel 80 includes a threaded shaft 82 which is in rotating connection within a threaded bore 84 of the body 12. As the adjustment wheel is rotated, the threaded shaft 82 is operative to move up or down and thereby urge the forward concave portion 18 to move up or down with respect to the body 12.

In this described alternative exemplary embodiment, a shaft of a golf club positioned adjacent the forward concave portion 18 may be finely moved closer to or away from the cutting blades of the apparatus to a position which is optimal for slicing the grip of the golf club with the cutting blades. In other alternative embodiments the blades 30 and 32 may be configured to adjustably slide up or down with respect to the brackets 26 and 28. Also in other alternative embodiments the brackets 26 and 28 may be adapted to accept different sizes of blades, such that the blades 30 and 32 may be exchanged with smaller or larger blades depending on the diameter of the club shaft. Also in alternative embodiments, the apparatus may be operative to releasably accept a plurality of different removable forward concave portions 18. Such removable forward concave portions may be produced in a plurality of different sizes and shapes which correspond to specific sizes and shapes of golf club shafts and grips.

As shown in FIG. 2, the apparatus body 12 of the exemplary embodiment includes a ramp 56 beneath the forward concave portion 18 of the shaft guide. In the exemplary embodiment the ramp 56 includes an angle for the front surface 58 of the ramp 56 that is less than 25 degrees with respect to a horizontal plane that is parallel to the shaft guide 16. The aft surfaces 60 of the ramp are curved at an increasingly larger angle. As shown in FIG. 4, as the blades slice through the grip 24, this exemplary curvature of the ramp 56 is operative to direct the cut out portion 62 of the grip away from the club shaft 22. In this exemplary embodiment the ramp 56 prevents the cut out portion 62 from buckling against the front of the apparatus body 12 which would hinder the slicing ability of the apparatus. In the exemplary embodiment the forward edge of the ramp 56 is about 3⁄16 inch aft of the cutting edge of each blade.

As shown in FIG. 2 with respect to blade 30, the cutting edges 66 of each blade are inwardly curved. This exemplary shape of the blades has been found to increase the cutting performance of the apparatus by lifting the grip from the shaft as the grip is sliced. This feature also assists in guiding the cut out portion 62 along the ramp 56.

In the exemplary embodiment, the apparatus uses double-sided carpet blades. Such blades include a second cutting edge 64 that is a mirror image of the cutting edge 66. The bracket 26 is operatively sized to conceal the second cutting edge 66. When the first cutting edge 66 becomes dull, the top section 44 of the bracket can be removed to allow a user to flip the blade 30 so that the second cutting edge 64 may be used to slice through grips.

An exemplary method of using the apparatus is shown in FIG. 4. Here the end of the golf club 68 is placed against the ground 70 or some other sturdy surface. The apparatus 10 is then placed against the club shaft 22 with the shaft aligned in the concave portions 18 and 20 of the shaft guide 16. A user may then grasp the handle 14 and slide the apparatus 10 along the club shaft 22 toward the grip 24. The blades are operative to slice through the grip 24 and direct the cut out portion of the grip 62 to curl away from the shaft 22. When the apparatus 10 reaches the ground 70, the grip 24 may be peeled away from the shaft. The exemplary embodiment of the present invention is operative to take advantage of the increased leverage that can be achieved by pushing the apparatus down with the bottom of the club 68 braced against a sturdy surface 70.

Thus the grip removing apparatus achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

What is claimed is:

1. A grip removing apparatus comprising:

a body;

a shaft guide in operative connection with the body, wherein the shaft guide includes at least one concave portion for receiving a golf club shaft;

at least two blades in operative connection with the body, wherein when the golf club shaft is positioned adjacent the concave portion of the shaft guide, a face of each blade extends in a generally radial direction with respect to the golf club shaft;

a ramp in operative connection with the body, wherein the ramp includes a surface that extends in a direction from the golf club shaft that is intermediate the at least two blades, wherein the ramp is operative to direct a cut out portion of a grip away from the golf club shaft.

2. The grip removing apparatus according to claim 1, wherein each blade includes a cutting edge that is inwardly curved.

3. A grip removing apparatus comprising:

a body;

a shaft guide in operative connection with the body, wherein the shaft guide includes at least one concave portion for receiving a golf club shaft;

at least two blades in operative connection with the body, wherein when the golf club shaft is positioned adjacent the concave portion of the shaft guide, a face of each blade extends in a generally radial direction with respect to the golf club shaft, wherein each blade is positioned at about a thirty degree angle from each side of a vertical plan that bisects the shaft guide.

4. A grip removing apparatus comprising:

a body;

a shaft guide in operative connection with the body, wherein the shaft guide includes at least one concave portion for receiving a golf club shaft;

at least two blades in operative connection with the body, wherein when the golf club shaft is positioned adjacent the concave portion of the shaft guide, a face of each blade extends in a generally radial direction with respect to the golf club shaft;

at least two brackets which are operative to releasably hold the at least two blades, and wherein the at least two brackets are operative to adjustably increase or decrease the distance between the at least two blades and the club shaft.

5. A grip removing apparatus comprising:

a body;

a shaft guide in operative connection with the body, wherein the shaft guide includes at least one concave portion for receiving a golf club shaft;

at least two blades in operative connection with the body, wherein when the golf club shaft is positioned adjacent the concave portion of the shaft guide, a face of each blade extends in a generally radial direction with respect to the golf club shaft, wherein the shaft guide is adjustable in height with respect to the body, whereby the distance between the edge of each blade and the club shaft may be modified by changing the height of the shaft guide.

6. The grip removing apparatus according to claim 5, further comprising an adjustment wheel in rotating connection with the body, wherein the adjustment wheel includes a shaft that is operative to urge the shaft guide towards or away from the blades as the adjustment wheel is rotated.

7. A grip removing apparatus comprising:

a body;

a shaft guide in operative connection with the body, wherein the shaft guide includes at least one concave portion for receiving a golf club shaft;

at least two blades in operative connection with the body, wherein when the golf club shaft is positioned adjacent the concave portion of the shaft guide, a face of each blade extends in a generally radial direction with respect to the golf club shaft;

a ramp in operative connection with the body, wherein the ramp includes a curved surface that is operative to direct a cut out portion of a grip away from the golf club shaft.

8. The grip removing apparatus according to claim 1, further comprising two guards in operative connection with the body adjacent each blade.

9. The grip removing apparatus according to claim 8, wherein the body includes an integral handle.

10. The grip removing apparatus according to claim 1, wherein faces of the blades are orientated closer to being positioned normal to a surface of the shaft than to being positioned tangent to the surface of the shaft.

11. The grip removing apparatus according to claim 1, further comprising two brackets, wherein each bracket is operative to hold a carpet blade that includes cutting edges at two opposed ends of the carpet blade.

12. A grip removing apparatus comprising:

a body;

a shaft guide in operative connection with the body, wherein the shaft guide includes at least one concave portion for receiving a golf club shaft;

at least one blade in releasable connection with the body, wherein the at least one blade is positioned generally radially with respect to the golf club shaft, wherein the at least one blade includes an inwardly curved cutting edge, wherein when shaft guide is slid along the golf club shaft, the cutting edge of the at least one blade is operative to slice through a grip mounted to the golf club shaft, wherein the shaft guide is adjustable in height with respect to the body, whereby the distance between the edge of each blade and the club shaft may be modified by changing the height of the shaft guide.

13. The grip removing apparatus according to claim 12, further comprising an adjustment wheel in rotating connection with the body, wherein the adjustment wheel includes a shaft that is operative to urge the shaft guide towards or away from the at least one blade as the adjustment wheel is rotated.

* * * * *